United States Patent [19]

Deverell

[11] 4,102,677

[45] Jul. 25, 1978

[54] AUSTENITIC STAINLESS STEEL

[75] Inventor: Harry E. Deverell, Natrona Heights, Pa.

[73] Assignee: Allegheny Ludlum Industries, Inc., Pittsburgh, Pa.

[21] Appl. No.: 746,972

[22] Filed: Dec. 2, 1976

[51] Int. Cl.[2] ..... C22C 38/44

[52] U.S. Cl. ..... 75/128 A; 75/128 E; 75/128 N; 75/128 G; 75/128 T; 75/128 V; 75/128 W

[58] Field of Search ..... 148/38; 75/122, 128 W, 75/128 A, 128 E, 128 N, 128 G, 128 V, 128 T

[56] References Cited

U.S. PATENT DOCUMENTS

| | | | |
|---|---|---|---|
| 2,553,330 | 5/1951 | Post et al. | 75/122 |
| 3,152,934 | 10/1964 | Lula et al. | 148/36 |
| 3,300,347 | 1/1967 | Kasza et al. | 148/12.3 |
| 3,551,142 | 12/1970 | Decroix | 75/128 N |
| 3,726,668 | 4/1973 | Baümel | 75/128 N |
| 3,756,807 | 9/1973 | Hoshino et al. | 75/128 N |
| 3,969,109 | 7/1976 | Tanczyn | 75/128 N |
| 4,007,038 | 2/1977 | Deverell | 75/122 |

FOREIGN PATENT DOCUMENTS

| | | | |
|---|---|---|---|
| 1,070,744 | 6/1967 | United Kingdom | 75/128 N |
| 1,224,898 | 3/1971 | United Kingdom | 75/128 N |

OTHER PUBLICATIONS

Stahlschlüssel, 10th Edition, 1974, p. 298, Nos. 47, 48.

*Primary Examiner*—Arthur J. Steiner

*Attorney, Agent, or Firm*—Vincent G. Gioia; Robert F. Dropkin

[57] ABSTRACT

A hot workable austenitic stainless steel of improved pitting and crevice corrosion resistance to the chloride ion. The steel consists essentialy of, by weight, from 18 to 20% chromium, 11 to 14% nickel, 3 to 4% molybdenum, up to 2% manganese, up to 0.01% sulfur, up to 0.1% of at least one element from the group consisting of cerium, calcium and magnesium, nitrogen from 0.1% up to its solubility limit, up to 0.08% carbon, up to 1% silicon, up to 1% columbium, up to 0.3% vanadium, up to 0.3% titanium, balance essentially iron.

10 Claims, No Drawings

AUSTENITIC STAINLESS STEEL

The present invention relates to an austenitic stainless steel.

Contact between metallic surfaces and chloride ions often results in a type of corrosion known as pitting; and one which is of a particularly serious nature in environments such as sea water, those encountered in certain chemical processes and pulp and paper plant media. While most forms of corrosion proceed at a predictable and uniform rate, pitting is characterized by its unpredictability. Pitting is concentrated in specific and unpredictable parts of the metallic surface; and once initiated, accelerates itself by concentrating the chloride ion into the initiated pit. Throughout this specification "pitting" is intended to include both pitting and crevice corrosion. When a crevice is present through design or deposits, the type of attack is better described as crevice corrosion. Crevice corrosion is, however, commonly referred to as pitting.

Described herein is a modified AISI Type 317 alloy; a hot workable austenitic alloy of improved pitting resistance. Specifically, a 317 alloy having a nitrogen content of at least 0.1% and a sulfur content no higher than 0.01%. Nitrogen has been found to increase the alloy's pitting resistance. Sulfur has been found to have a deleterious effect upon hot workability. Prior art 317 alloys generally called for nitrogen contents of 0.03% or less, and maximum sulfur contents of 0.03%. In some instances nitrogen levels were raised to about 0.07% to achieve an austenitic phase balance with lesser amounts of costly nickel. Low sulfur is preferably attained through additions of cerium, calcium and/or magnesium.

As the subject alloy is austenitic, it must contain a sufficient amount of austenite promoting elements in contrast to ferrite promoting elements. Austenite promoting elements include nickel, manganese, nitrogen and carbon. Ferrite promoting elements include chromium, molybdenum and silicon. Austenitic steels have received greater acceptance than ferritic and martensitic steels because of their generally desirable combination of properties which include ease of welding, excellent toughness and general corrosion resistance.

A number of prior art alloys have some similarities to that of the subject application, but nevertheless are significantly different therefrom. With regard thereto, particular attention is directed to U.S. Pat. Nos. 2,229,065; 2,398,702; 2,553,330; 3,129,120; 3,716,353; and 3,726,668 and U.S. patent application Ser. No. 571,460 (filed Apr. 25, 1975), now Pat. No. 4,007,038. Significantly, not one of the references discloses the alloy of the subject application. Not one of them disclose the combination of elements whose synergistic effect gives the subject alloy its unique combination of properties.

It is accordingly an object of the present invention to provide an austenitic stainless steel having a combination of elements whose synergistic effect gives it a highly desirable combination of properties.

The alloy of the present invention is a hot workable austenitic steel of improved pitting and crevice resistance to the chloride ion. It consists essentially of, by weight, from 18 to 20% chromium, 11 to 14% nickel 3 to 4% molybdenum, up to 2% manganese, up to 0.01% sulfur, up to 0.1% of at least one element from the group consisting of cerium, calcium and magnesium, nitrogen from 0.1% up to its solubility limit, up to 0.08% carbon, up to 1% silicon, up to 1% columbium, up to 0.3% vanadium, up to 0.3% titanium, balance essentially iron.

Chromium, molybdenum and silicon are ferritizing elements. Chromium is added for oxidation and general corrosion resistance as well as for pitting resistance. Preferred levels of chromium are from 18.2 to 19.5%. Like chromium, molybdenum is added for pitting resistance. Preferred levels of molybdenum are from 3.25% to 3.75%. Silicon aids in the melting of the alloy, and is preferably maintained at a level no greater than 0.75%.

As the alloy of the present invention is austenitic, the ferritizing effect of chromium, molybdenum, silicon and optional elements such as columbium, must be offset by austenitizing elements. The austenitizing elements of the subject alloy are nickel, manganese, nitrogen and carbon. Of them, nickel is the primary austenitizer. It is preferably present in amounts of from 12 to 13.75%. Nitrogen, in addition to serving as an austenitizer, contributes to the alloy's strength and significantly enhances its pitting resistance. It must be present in amount of at least 0.1%, and preferably in amounts of at least 0.15%. Manganese increases the alloys' solubility for nitrogen. The nitrogen solubility limit for the subject alloy is about 0.3%. Carbon is often kept below 0.03% as it can cause intergranular corrosion in the weld heat-affected zone. In another embodiment, carbon is tied up with additions of stabilizng elements from the group consisting of columbium, vanadium and titanium. Such embodiments contain at least 0.1% of one or more of these elements.

To enhance the hot workability of the subject alloy, sulfur is maintained at a level no higher than 0.01%, and preferably at a maximum level of 0.007%. Low sulfur is preferably attained through additions of cerium, calcium and/or magnesium. Alloys within the subject invention generally contain from 0.015 to 0.1% of said elements, and preferably from 0.02 to 0.1%. Cerium additions can be made through additions of Mischmetal. In addition to reducing sulfur levels, cerium, calcium and magnesium are believed to retard cold shortness, which gives rise to edge checks. Edge checks, which include edge and corner cracks and tears, are hot working defects which result from poor ductility, generally at the cold end of the hot working range.

In a particular embodiment, the alloy of the present invention has from 18.2 to 19.5% chromium, at least 0.15% nitrogen, 12 to 13.75% nickel, 3.25 to 3.75% molybdenum and 0.015 to 0.1% of at least one element from the group consisting of cerium, calcium and magnesium. Another embodiment is further limited in that it has at least 0.02% of at least one element from said group.

The following examples are illustrative of several aspects of the invention.

EXAMPLE I

Five alloys (alloys A, B, C, D and E) were hot rolled to a 0.140" band, annealed at 2050° F, cold rolled to 0.065", reannealed, pickled and skin passed to 0.060"; and subsequently subjected to a 72 hour room temperature 10% ferric chloride, 90% distilled water rubber band test. The chemistry of the alloys appears hereinbelow in Table I.

TABLE I

| Alloy | Composition (wt. %) | | | | | | | | | | |
|---|---|---|---|---|---|---|---|---|---|---|---|
| | Cr | Ni | Mo | Mn | S | Ca | Ce | N | Si | C | Fe |
| A | 18.52 | 13.5 | 3.50 | 1.57 | 0.026 | — | — | 0.030 | 0.50 | 0.064 | Bal. |
| B | 18.50 | 13.5 | 3.50 | 1.57 | 0.006 | — | — | 0.032 | 0.50 | 0.060 | Bal. |
| C | 18.52 | 13.4 | 3.57 | 1.57 | 0.002 | 0.004 | 0.038 | 0.030 | 0.49 | 0.075 | Bal. |
| D | 18.23 | 13.59 | 3.59 | 1.57 | 0.002 | 0.004 | 0.028 | 0.11 | 0.50 | 0.065 | Bal. |
| E | 18.50 | 13.49 | 3.55 | 1.57 | 0.003 | 0.004 | 0.022 | 0.20 | 0.51 | 0.069 | Bal. |

Three samples of each alloy were subjected to the rubber band test. The initial weight of the samples was between 15 and 16 grams. The test results appear hereinbelow in Table II.

TABLE II

| Change in Weight (gms.) | | | | |
|---|---|---|---|---|
| A | B | C | D | E |
| 0.1913 | 0.1933 | 0.2115 | 0.0627 | 0.0068 |
| 0.5608 | 0.5291 | 0.4226 | 0.0314 | 0.0111 |
| 0.3040 | 0.1971 | 0.3070 | 0.1292 | 0.0254 |
| 0.3520 (avg.) | 0.3065 (avg.) | 0.3137 (avg.) | 0.0744 (avg.) | 0.0144 (avg.) |

From Table II, it is clear that the corrosion resistance of alloys D and E is superior to that of alloys A, B and C. Significantly, alloys D and E had a nitrogen content in excess of 0.1%, whereas alloys A, B and C had nitrogen contents below 0.1%. The alloy of the subject invention is dependent upon a nitrogen content of at least 0.1%, and preferably upon one in excess of 0.15%.

EXAMPLE II

Additional samples from alloys A through E were heated to a temperature of 2250° F, hot rolled and observed for edge checking at various finishing temperatures. The results of the study appear hereinbelow in Table III.

TABLE III

| Alloy | Gage (inches) | Finishing Temp. (° F) | Condition |
|---|---|---|---|
| A | 0.625 | 1950 | No checks |
| | 0.120 | 1720 | Few light edge checks at back end |
| | 0.141 | 1550 | Light checks ¼–⅜" |
| B | 0.625 | 2000 | No checks |
| | 0.110 1860 | No checks | |
| | 0.144 | 1550 | Light checks to ¼" |
| C | 0.625 | 2050 | No checks |
| | 0.102 | 1820 | No checks |
| | 0.136 | 1550 | No checks |
| D | 0.625 | 2050 | No checks |
| | 0.115 | 1980 | No checks |
| | 0.139 | 1580 | No checks |
| E | 0.625 | 2075 | No checks |
| | 0.114 | 1840 | No checks |
| | 0.144 | 1575 | No checks |

From Table III, it is noted that the hot workability of alloys, B, C, D and E is superior to that of Alloy A. Edge checking is more pronounced in alloy A than in alloys B, C, D and E. Significantly, alloy A has a sulfur content in excess of 0.01%, whereas that of alloys B, C, D and E is less than 0.01%; as required by the subject invention. Edge checking is also more prominent in alloy B than in alloys C, D and E. Significantly alloys C, D and E have additions of calcium and cerium in excess of 0.015%, whereas alloy B does not. As stated hereinabove, edge checks, which include edge and corner cracks and tears, are hot working defects which result from poor ductility, generally at the cold end of the hot working range. They result in torn metal which must be ground or sheared off, and in turn, lower metallic yields.

It will be apparent to those skilled in the art that the novel principles of the invention disclosed herein in connection with specific examples thereof will suggest various other modifications and applications of the same. It is accordingly desired that in construing the breadth of the appended claims that they shall not be limited to the specific examples of the invention described herein.

I claim:

1. A hot workable, pitting and crevice corrosion resistant austenitic stainless steel, consisting essentially of, by weight, from 18 to 20% chromium, 11 to 14% nickel, 3.25 to 3.75% molybdenum, up to 2% manganese, up to 0.01% sulfur, from 0.015 to 0.1% of at least one element from the group consisting of cerium, calcium and magnesium, nitrogen from 0.1% up to about 0.3%, up to 0.08% carbon, up to 1% silicon, up to 1% columbium, up to 0.3% vanadium, up to 0.3% titanium, balance essentially rion.

2. A hot workable austenitic stainless steel according to claim 1, having from 18.2 to 19.5% chromium.

3. A hot workable austenitic stainless steel according to claim 1, having at least 0.15% nitrogen.

4. A hot workable austenitic stainless steel according to claim 1, having from 12 to 13.75% nickel.

5. A hot workable austenitic stainless steel according to claim 1, having from 0.015 to 0.1% of at least one element from the group consisting of cerium and calcium.

6. A hot workable austenitic stainless steel according to claim 1, having at least 0.02% of at least one element from the group consisting of cerium, calcium and magnesium.

7. A hot workable austenitic stainless steel according to claim 1, having up to 0.007% sulfur.

8. A hot workable austenitic stainless steel according to claim 1, having at least 0.1% of at least one element from the group consisting of columbium, vanadium and titanium.

9. A hot workable austenitic stainless steel according to claim 1, having from 18.2 to 19.5% chromium, at least 0.15% nitrogen, 12 to 13.75% nickel, 3.25 to 3.75% molybdenum and 0.015 to 0.1% of at least one element from the group consisting of cerium, calcium and magnesium.

10. A hot workable austenitic stainless steel according to claim 9, having at least 0.02% of at least one element from the group consisting of cerium, calcium and magnesium.

* * * * *